US009869428B2

(12) United States Patent
Drube

(10) Patent No.: US 9,869,428 B2
(45) Date of Patent: Jan. 16, 2018

(54) LIQUID NATURAL GAS COOLING ON THE FLY

(71) Applicant: Chart Industrie, Inc., Ball Ground, GA (US)

(72) Inventor: Tom Drube, Lakeville, MN (US)

(73) Assignee: Chart Industries, Inc., Ball Ground, GA (US)

( * ) Notice: Subject to any disclaimer, the term of this patent is extended or adjusted under 35 U.S.C. 154(b) by 142 days.

(21) Appl. No.: 14/258,873

(22) Filed: Apr. 22, 2014

(65) Prior Publication Data

US 2014/0311591 A1 Oct. 23, 2014

Related U.S. Application Data

(60) Provisional application No. 61/814,697, filed on Apr. 22, 2013.

(51) Int. Cl.
*F17C 7/02* (2006.01)
*F17C 9/02* (2006.01)
(Continued)

(52) U.S. Cl.
CPC ..... *F17C 5/007* (2013.01); *F04B 15/08* (2013.01); *F04B 37/08* (2013.01); *F17C 2205/037* (2013.01); *F17C 2205/0323* (2013.01); *F17C 2205/0326* (2013.01); *F17C 2205/0332* (2013.01); *F17C 2205/0335* (2013.01); *F17C 2205/0352* (2013.01);
(Continued)

(58) Field of Classification Search
CPC .... F04B 15/08; F17C 5/007; F17C 2265/065; F17C 2227/0337; F17C 2227/0341; F17C 2227/0353; F17C 2227/0355; F17C 2223/0161; F17C 2225/0161; F17C 2225/0165; F17C 2205/0323; F17C 2205/0326; F17C 2205/0332; F17C 2205/0335; F17C 2250/032; F17C 2250/043; F17C 2250/0439
See application file for complete search history.

(56) References Cited

U.S. PATENT DOCUMENTS 1,804,072 A * 5/1931 Turrettini ..... F25B 21/02 136/203
5,121,609 A * 6/1992 Cieslukowski ..... F17C 7/02 123/525
(Continued)

FOREIGN PATENT DOCUMENTS

| | | | |
|---|---|---|---|
| CN | 1338586 | A | 3/2002 |
| CN | 102027236 | A | 4/2011 |
| CN | 102713402 | A | 10/2012 |
| DE | 10 2009 037108 | A1 | 2/2011 |

*Primary Examiner* — Keith Raymond
(74) *Attorney, Agent, or Firm* — Mintz Levin Cohn Ferris Glovsky and Popeo, P.C.

(57) ABSTRACT

Described herein are systems and methods for cryogenic fluid delivery to achieve the lowest reasonable saturation pressure while dispensing a cryogenic fluid such as liquefied natural gas to a holding tank on a use device. The systems and methods utilize a liquid nitrogen component and a liquefaction engine, very cold liquefied natural gas and a liquefaction engine, or a combination of both very cold liquefied natural gas and a liquid nitrogen component to deliver LNG to a holding tank on a use device.

4 Claims, 4 Drawing Sheets

(51) Int. Cl.

| | |
|---|---|
| ***F17C 13/00*** | (2006.01) |
| ***F17C 5/00*** | (2006.01) |
| ***F04B 15/08*** | (2006.01) |
| ***F04B 37/08*** | (2006.01) |

(52) U.S. Cl.

CPC ..... *F17C 2221/033* (2013.01); *F17C 2223/0161* (2013.01); *F17C 2223/033* (2013.01); *F17C 2223/043* (2013.01); *F17C 2223/046* (2013.01); *F17C 2225/0161* (2013.01); *F17C 2225/035* (2013.01); *F17C 2227/015* (2013.01); *F17C 2227/0135* (2013.01); *F17C 2227/0339* (2013.01); *F17C 2227/0341* (2013.01); *F17C 2227/0353* (2013.01); *F17C 2227/0372* (2013.01); *F17C 2227/0374* (2013.01); *F17C 2250/032* (2013.01); *F17C 2250/0439* (2013.01); *F17C 2250/0636* (2013.01); *F17C 2260/056* (2013.01); *F17C 2265/065* (2013.01); *F17C 2270/0139* (2013.01); *Y10T 137/6579* (2015.04); *Y10T 137/85978* (2015.04)

(56) References Cited

U.S. PATENT DOCUMENTS 5,771,946 A * 6/1998 Kooy ..... F17C 6/00 141/11

6,354,088 B1 3/2002 Emmer et al.

* cited by examiner

LIQUID NATURAL GAS COOLING ON THE FLY

CROSS-REFERENCE TO RELATED APPLICATION

This application claims priority to U.S. Provisional Patent Application Ser. No. 61/814,697, titled "Liquid Natural Gas Cooling On The Fly," filed Apr. 22, 2013, the disclosure of which is hereby incorporated by reference in its entirety herein.

BACKGROUND

Ensuring proper operation of many devices that use liquefied natural gas (LNG) requires controlling the boiling pressure and temperature of the LNG delivered to the device. Controlling the boiling pressure (i.e. saturation pressure) of LNG in onboard vehicle fuel tanks is of particular interest. Conventionally, fuel delivery systems keep the saturation pressure, or boiling pressure, of LNG sufficiently high to ensure pressure is available to drive the natural gas to the engine of the use device.

In use device systems that include an onboard pump, the vehicle tanks that store LNG can utilize the onboard pump in place of venting vaporized natural gas. This increases the LNG holding time in the vehicle tank before venting of gas is necessary. In the course of delivering LNG, the liquefied natural gas absorbs heat, such as during pumping and other normal handling. To effectively remove heat and deliver LNG to the vehicle tank of a use device, the location of means for removing heat from LNG could be in the path of liquefied natural gas delivery, after the dispensing pump, on the way to the vehicle tank. Such configurations achieve lower LNG saturation pressures while dispensing liquefied natural gas to a use device.

SUMMARY

Provided herein are systems and apparatus for controlling the temperature and saturation pressure of liquefied natural gas (LNG) while dispensing LNG to a use device, particularly a fuel tank of a LNG fueled vehicle. Methods of delivering LNG to a use device at the lowest reasonable saturation pressure are also provided.

In some embodiments, a system is provided for delivering a cryogenic fluid fuel at a predetermined saturation pressure to a fuel tank. The fuel tank can include a source tank, a pump, a cooling component, an ambient temperature, and a temperature sensing valve. The source tank has a top portion and a second portion, and the source tank contains a fuel, the fuel comprising a gas portion and a liquid portion. The pump is fluidly connected to the portion of the source tank by a vapor line and the bottom portion of the source tank by a liquid line, the pump configured to pump the fuel from the source tank towards vehicle fuel tank. The cooling component is configured to surround a cooling line with a cooling cryogenic fluid, the cooling line fluidly connected to an outlet of the pump at a first end and to a controlled inlet line at a second end, the controlled inlet line in fluid communication with the vehicle fuel tank. The ambient temperature line has first end connected to the outlet of the pump and a second end connected to the controlled inlet line. The temperature sensing valve controller is connected to a cold fuel control valve at the second end of the cooling line, a warm fuel control valve at the second end of the ambient temperature line, and the controlled inlet line. In such embodiments, the temperature sensing valve controller is configured to measure a temperature of the fuel in the controlled inlet line and to control the flow of fuel through the cold fuel control valve and warm fuel control valve to maintain the temperature of the fuel in the controlled inlet line within a predetermined temperature range.

The following features can be present in the system in any reasonable combination. In some embodiments, the cooling component includes a cooling tank with a top portion and a bottom portion in which the top portion of the cooling component surrounds a gas portion of the cooling cryogenic fluid and the bottom portion of the cooling component surrounds a liquid portion of the cooling cryogenic fluid. In some such embodiments, the system further includes a pressure control valve in fluid communication with the cooling component, in which the pressure control valve connected to the top portion of the cooling component. The pressure control valve releases cooling cryogenic fluid when a pressure of the cooling cryogenic fluid in the cooling component exceeds a predetermined set temperature, in some embodiments. The system can include an alternate venting line in which the alternate venting line has a first end in fluid communication with the liquid portion of the cooling cryogenic fluid and a second end in fluid communication with a venting valve. The alternate venting line can also include a contact portion that contacts the gas portion of the fuel in the source tank. In such embodiments, a rate of venting cooling cryogenic fluid from the alternate venting line depends on a set point of vapor pressure of the fuel inside the source tank. The system can further include a dispenser tank fluidly connected to the controlled inlet line and to the vehicle fuel tank, and the system can further include a direct input line with a first end fluidly connected to the source tank and a second end fluidly connected to the dispense tank. The fuel can be a liquefied natural gas. The cooling cryogenic fluid can be nitrogen in some embodiments. The cooling component can include two tanks connected by a conduit that includes a one-way valve. In such embodiments, the two tanks can include a first tank for containing cooling cryogenic fluid at a first pressure and a second tank for containing cooling cryogenic fluid at a second pressure, in which the first pressure is lower than or equal to the second pressure. Further, in such embodiments, the first tank is fluidly connected to a liquefaction engine, the second tank is configured to surround the cooling line with the cooling cryogenic fluid, and the one-way valve can be configured to allow fluid flow only from the first tank to the second tank when the first and second pressure are equal.

In a related aspect, a system for delivering a cryogenic fluid fuel at a predetermined saturation pressure to a fuel tank is provided. The system can include a source tank, a pump, a cooling component, an ambient temperature line, and a temperature sensing valve controller. The source tank can have a top portion and a second portion, in which the source tank contains a fuel and the fuel includes a gas portion and a liquid portion. The pump can be fluidly connected to the top portion of the source tank by a vapor line and the connected to the bottom portion of the source tank by a liquid line, in which the pump can be configured to pump the fuel from the source tank towards a vehicle fuel tank. The cooling component can contain a cooling cryogenic fluid, in which the cooling component is fluidly connected to a liquefaction engine. The pump, a controlled inlet line, and the controlled inlet line can be fluidly connected to the vehicle fuel tank. The ambient temperature line can have a first end connected to the outlet of the pump and a second end connected to the controlled inlet line. The temperature sensing valve controller can be connected to a cold fuel control valve at the second end of the cooling line, a warm fuel control valve at the second end of the ambient temperature line, and the controlled inlet line. The temperature sensing valve controller can be configured to measure a temperature of the fuel in the controlled inlet line and control the flow of fuel through the cold fuel control valve and warm fuel control valve to maintain the temperature of the fuel in the controlled inlet line within a predetermined temperature range, in which the fuel includes liquefied natural gas at a second pressure, the first pressure lower than the second pressure.

In some embodiments, the following features can be present in the system in any reasonable combination. The liquefaction engine of the system can be configured to remove heat from the cooling cryogenic fluid using electrical energy. The system can further include a dispenser tank that is fluidly connected to the controlled inlet line and to the vehicle fuel tank. The system can further include a direct input line with a first end fluidly connected to the source tank and a second end fluidly connected to the dispenser tank. The system can further include a vapor relief line that includes a first end fluidly connected to the cooling component and a second end connected to the source tank. The vapor relief line can be configured to convey the vapor portion of the fuel from the source tank to the cooling component. In some such embodiments, the liquefaction engine can include heat removing lines through which a heat removing fluid flows, in which the heat removing lines are connected to a separate source of heat removing fluid in which the flow of heat removing fluid is controlled by one or more liquefaction engine valves to maintain a pressure of the cooling cryogenic fluid in the cooling component.

BRIEF DESCRIPTION OF THE DRAWINGS

In the figures.

Like reference numbers in the figures refer to the same or similar features.

DETAILED DESCRIPTION

Delivery systems for cryogenic fluids, particularly those used as fuel, need to be able to control the saturation pressure (i.e. boiling pressure) and temperature of the fluids during storage and delivery. In the case of liquefied natural gas (LNG), systems need to ensure that the saturation pressure enables natural gas to flow where it is needed, such as the engine of a vehicle, while being capable of holding the LNG at a saturation pressure low enough to increase the time before venting of gas from a vehicle tank in the system is needed. In view of the foregoing, there is a need for improved systems and methods for delivering liquefied natural gas at the lowest reasonable saturation pressure while dispensing LNG to a use device.

Disclosed is a cryogenic fluid storage and delivery system. The system is primarily described herein in the context of being used for a delivery of liquefied natural gas (LNG) from a large pressure vessel to a vehicle tank that provides fuel to a natural gas engine of a use device. However, although the disclosure is primarily described in terms of supplying fuel to a vehicle tank connected to an engine, it should be appreciated that the disclosed system may be configured for use with any application that uses cryogenic fluids.

Figure 1:
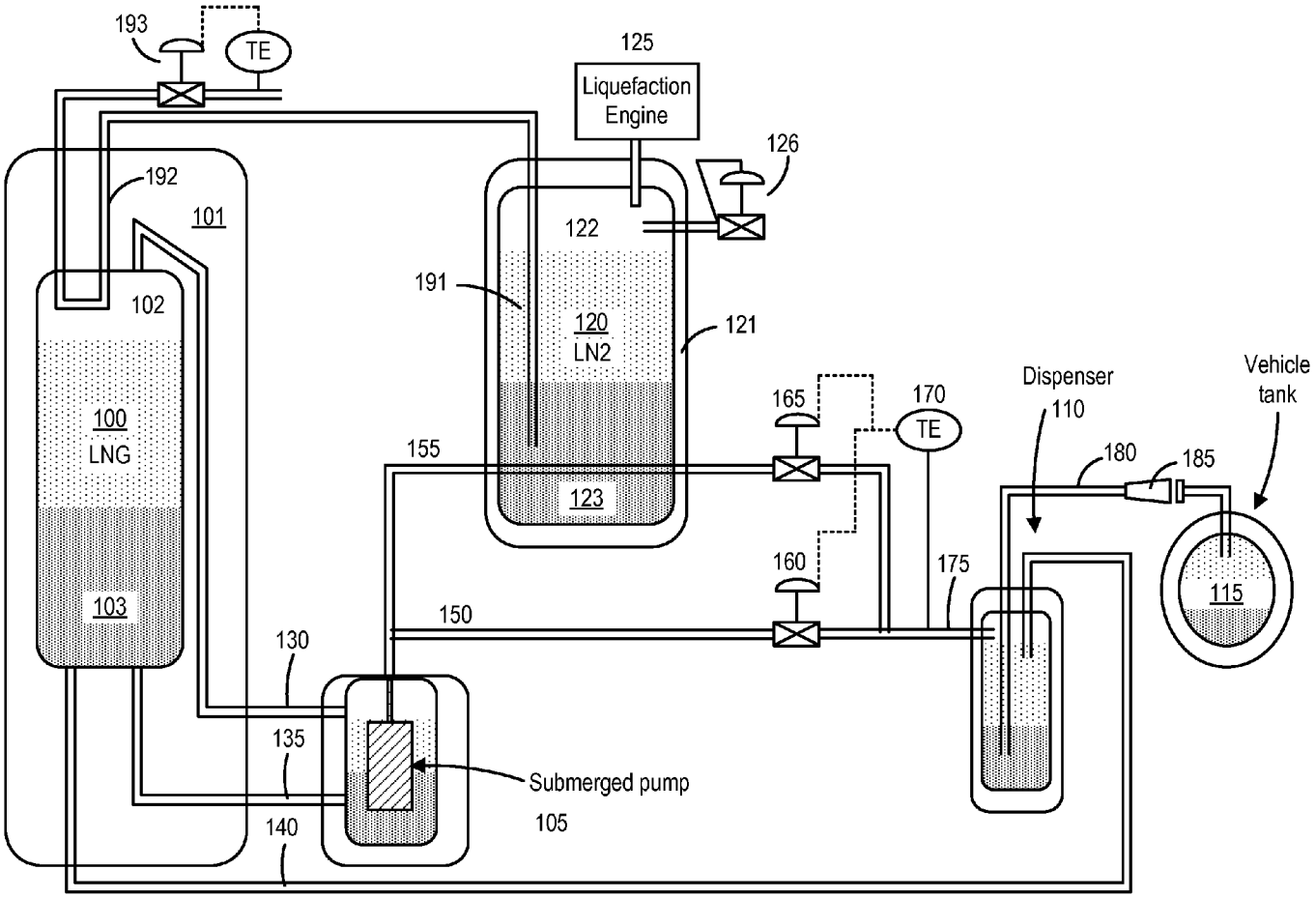
FIG. 1 shows an exemplary system diagram of a liquefied natural gas storage and delivery system with a liquid nitrogen cooling component.

FIG. 1 shows an exemplary system diagram of a liquefied natural gas storage and delivery system with a liquid nitrogen cooling component. The system includes a liquefied natural gas (LNG) tank 100 with an insulation layer 101, a vapor portion 102, and a liquid portion 103; a submerged pump 105; a liquid nitrogen (LN2) component 120; a liquefaction engine 125; a LNG dispenser 110; and a vehicle tank 115. The LNG tank 100 connects to the submerged pump 105 via a liquid line 135 and a vapor line 130. The submerged pump 105 in turn has an outlet line that splits into a cooling line 155 and an ambient temperature line 150. The cooling line 155 and ambient temperature line 150 join again at a temperature controlled inlet line 175 that leads into the dispenser 110. A temperature sensing valve controller 170 is located on the controlled inlet line 175 and connects to flow control valves 160, 165 on the ambient temperature line 150 and the cooling line 155, respectively. The LNG tank 100 also connects directly to the dispenser 110 by a direct input line 140. The dispenser 110 connects to the vehicle tank 115 through a tank feeding line 180 that has a connection adapter 185 that interfaces with a connector on the vehicle tank 115.

The liquid nitrogen component 120 is a cooling component. An insulating layer 121 surrounds the tank portion of the liquid nitrogen component 120. Inside of the liquid nitrogen component 120 are a vapor portion 122 and a liquid portion 123. The liquefaction engine 125 connects to the liquid nitrogen component 120 such that the liquefaction engine 125 is in fluid communication with the vapor portion 122 of the liquid nitrogen component. A nitrogen pressure control valve 126 is also in fluid communication with the vapor portion 122 of the liquid nitrogen component.

Liquid nitrogen does not directly contact LNG in the system shown in FIG. 1. Instead, liquid nitrogen either surrounds flowing LNG or flows through the LNG tank 100 to remove heat from the LNG. A dip tube 191 fluidly connects the liquid portion 123 of the liquid nitrogen component 120 with an alternate nitrogen venting line 192 that passes through the vapor portion 102 of the LNG tank 100. The alternate nitrogen venting line 192 terminates in a nitrogen venting valve 193. The cooling line 155 that fluidly connects the output LNG from the submerged pump 105 with the controlled inlet line 175 passes through the insulating layer 121 and the liquid portion 123 of the liquid nitrogen component 120.

In operation, liquefied natural gas (LNG) is kept at a certain temperature in the LNG tank 100 by controlling the saturation pressure of the LNG in the tank 100, by passing liquid nitrogen through the alternate nitrogen venting line 192, and with the help of the insulation layer 101. When LNG moves to the vehicle tank 115, the LNG can flow along two paths out of the LNG tank 100.

LNG can also leave the LNG tank 100 the liquid line 135 with help from the submerged pump 105. The action of the submerged pump 105 can add heat to the LNG. As the action of the submerged pump 105 forces the LNG through the ambient temperature line 150 and the cooling line 155, the temperature sensing valve controller 170 detects the temperature at the controlled inlet line 175 and controls the flow valves 160 and 165 accordingly until a desired temperature is detected at the controlled inlet line 175. Flowing LNG through the cooling line 155 removes heat from the LNG after the points in its path where energy is used to cause flow. Removing heat and controlling the delivery temperature at the controlled inlet line 175 allows for the LNG to be delivered at a suitably low saturation pressure.

The liquid nitrogen component 120 is maintained at a temperature and pressure that allows it to effectively cool LNG that flows through the cooling line 155. In the system shown in FIG. 1, liquid nitrogen is vented to the surrounding environment to maintain suitable pressure and temperature within the liquid nitrogen component, 120. The portion of liquid nitrogen that is vented as nitrogen gas can leave the liquid nitrogen component 120 through the nitrogen pressure control valve 126 or the alternate nitrogen venting line 192 that is connected to the nitrogen venting valve 193. Heat absorbed by the liquid nitrogen that surrounds the cooling line 155 can cause the pressure within the liquid nitrogen component 120 to rise, and the nitrogen pressure control valve 126 allows for nitrogen gas to vent to the atmosphere and lower the internal pressure. Pressure within the liquid nitrogen component 120 can also be lowered when liquid nitrogen flows up the dip tube 191, through the alternate venting line 192 that is in contact with the vapor portion 102 of the LNG tank 100. In addition to lowering the pressure in the liquid nitrogen component 120, movement of liquid nitrogen through the alternate venting line 192 can remove heat from the LNG tank 100 and lower the pressure in there as well. The liquefaction engine 125 also helps to maintain the liquid nitrogen within the liquid nitrogen component 120 at a suitable temperature and pressure. When it is undesirable to vent nitrogen to the atmosphere, the liquefaction engine 125 can use electricity to remove heat from the system in FIG. 1.

Figure 2:
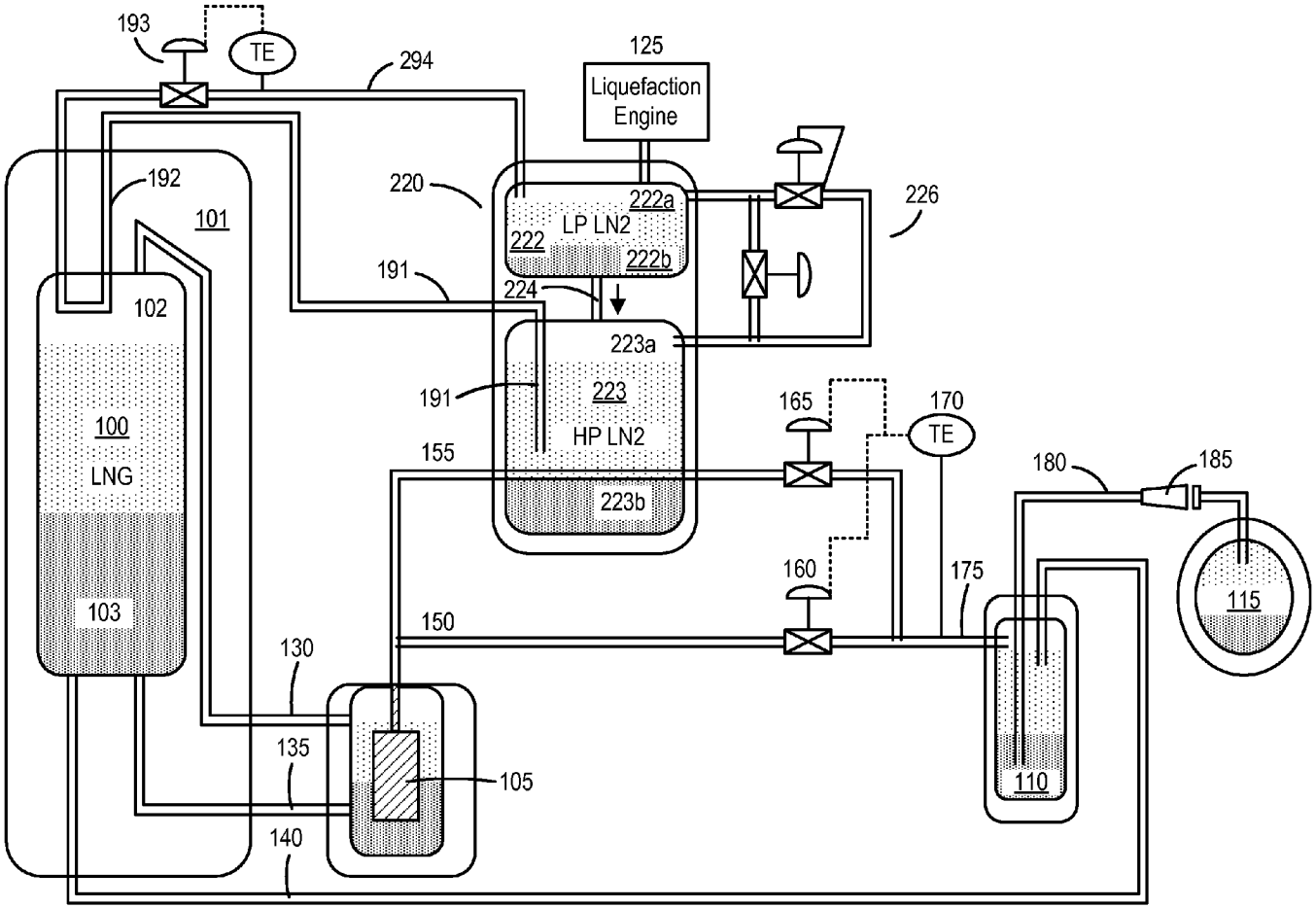
FIG. 2 shows another exemplary system of a liquefied natural gas storage and delivery system with a liquid nitrogen cooling component that accommodates liquid nitrogen at two pressure levels.

FIG. 2 shows another exemplary system of a liquefied natural gas storage and delivery system with a liquid nitrogen cooling component that accommodates liquid nitrogen at two pressure levels. The system shown in FIG. 2 is a closed-loop system, such that the nitrogen does not vent to the surrounding environment.

The system of FIG. 2 has most of the same components as the system of FIG. 1. The system shown in FIG. 2 has a liquid nitrogen cooling component 220 that is different from the liquid nitrogen component 120 shown in FIG. 1. The liquid nitrogen cooling component includes 220 two tanks 222, 223 at different pressures. The low pressure tank 222 has a vapor portion 222*a* and a liquid portion 222*b*. The high pressure tank 223, similarly, has a vapor portion 223*a* and a liquid portion 223*b*. The low pressure tank 222 is in fluid communication with the liquefaction engine 125, while the high pressure tank 223 surrounds the cooling line 155 and the dip tube 191. The low pressure tank 222 also is in fluid communication with a return line 294 that is connected to the alternate nitrogen venting line 192 and the nitrogen venting valve 193. The vapor portions of each tank 222*a*, 223*a* are also fluidly connected via a control valve system 226. The liquid portion of the low pressure tank 222*b* is in fluid communication with the high pressure tank 223 by a conduit 224 with a check valve that only allows fluid to flow in one direction, from the low pressure tank 222 to the high pressure tank 223.

In the system shown in FIG. 2, the liquefaction engine 125 is only in contact with the contents of the low pressure tank 222. The liquefaction engine 125 helps to maintain the pressure in the low pressure tank 222 lower than that in the high pressure tank 223, even when accepting liquid nitrogen that has passed through the alternate nitrogen venting line 192 and the nitrogen venting valve 193, absorbing heat from the vapor portion 102 of the LNG tank 100. As the liquefaction engine 125 operates, the low pressure tank 222 eventually fills with cold liquid nitrogen. When the low pressure tank 222 reaches a predetermined level of cold liquid nitrogen, the vapor portions of the low and high pressure tanks, 222*a* and 223*a*, respectively, can be equalized by activating the control valve system 226. Activating the control valve system 226 also causes the check valve in the conduit 224 to allow the cold liquid nitrogen from the low pressure tank 222 to flow into the high pressure tank 223. Normally, the pressure difference between the low pressure tank 222 and the high pressure tank 223 prevents this cold liquid nitrogen flow. The activation of the control valve system 226 equilibrates the pressure within the tanks of the liquid nitrogen cooling component 220, activating the check valve in the conduit 224. Thus, nitrogen is not vented from the system shown in FIG. 2, and electricity is used to remove heat from the fluids in the system via the liquefaction engine 125.

Figure 3:
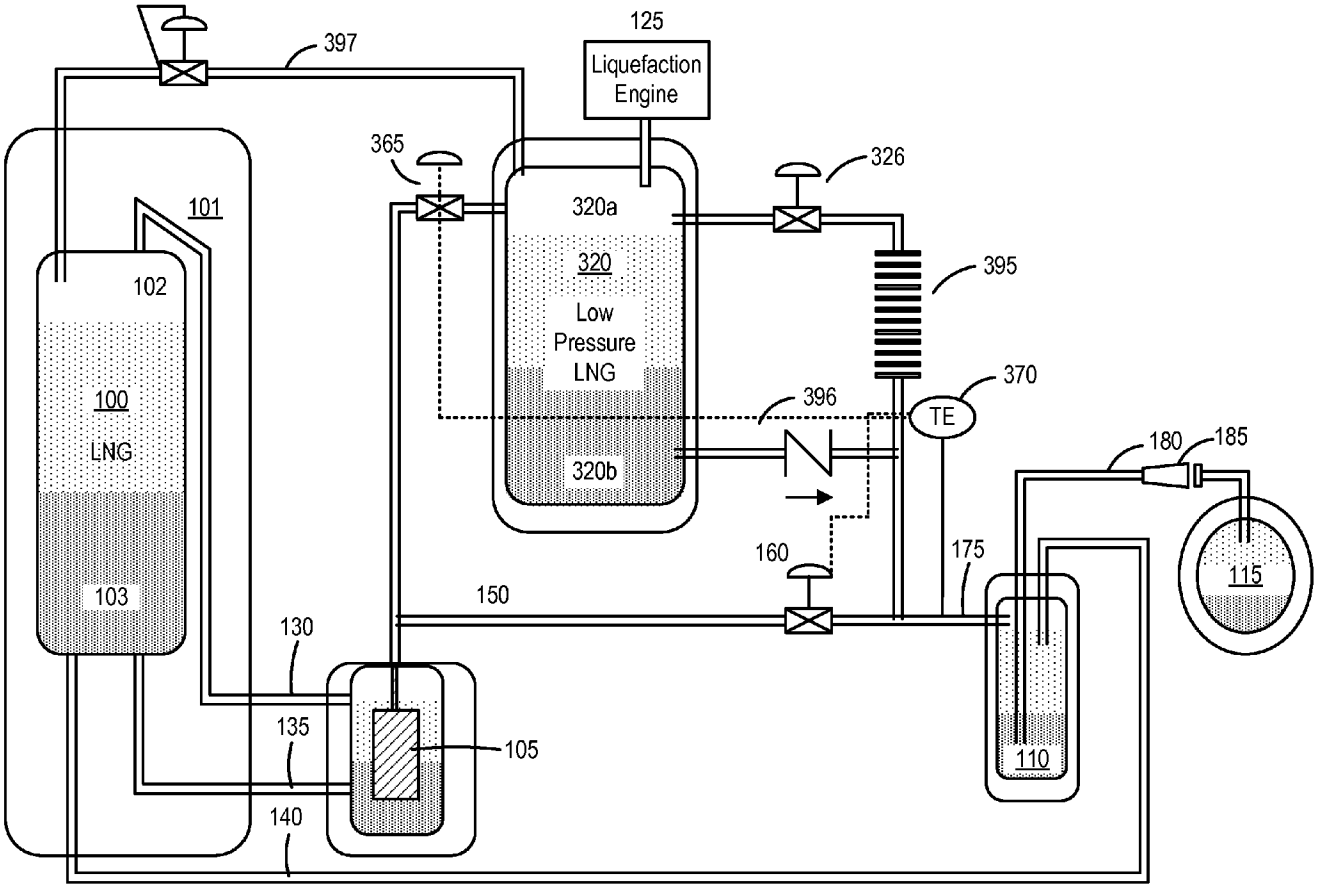
FIG. 3 shows an exemplary system diagram of a liquefied natural gas storage and delivery system in which the storage tank stores very cold liquefied natural gas that is kept cold by a liquefaction engine.

FIG. 3 shows an exemplary system diagram of a liquefied natural gas storage and delivery system in which a second LNG storage tank is used that stores very cold liquefied natural gas that is kept cold by a liquefaction engine. The second LNG storage tank is a low pressure LNG tank 320 with a vapor portion 320*a* and a liquid portion 320*b*. Besides the replacement of the liquid nitrogen component (120, 220 in FIGS. 1 and 2), the system shown in FIG. 3 differs from the previously discussed systems in that the cooling line 155 that passed through the tank of the liquid nitrogen component is absent. Instead, a low pressure outlet line 396 contributes lower saturation pressure, and lower temperature, LNG to the temperature controlled inlet line 175. A vapor relief line 397 fluidly connects the vapor portion 102 of the LNG tank 100 to the vapor portion 320*a* of the low pressure LNG tank 320. A relief line 395 and valve 326 are also connected to the low pressure LNG tank 320. The relief line 395 fluidly connects the low pressure LNG tank 320 to the lines leading to the dispenser 110. The dispenser 110 is fluidly connected to the LNG tank 100 by the line 140.

The liquefaction engine 125 can use electricity to remove heat from vapor coming through the vapor relief line 397 as well as liquid or vapor pumped into the low pressure LNG tank 320 by the submerged pump 105.

As in FIGS. 1 and 2, there is a temperature sensing controller 370 that detects the temperature at the temperature controlled inlet line 175 and then controls the flow through valves 365 and 160 appropriately. The valve that controls the flow of cold LNG 365 is located between the outlet of the submerged pump 105 and the inlet of the low pressure LNG 320. The low pressure outlet line 396 fluidly connects the liquid portion 320*b* of the low pressure LNG tank 320 to the temperature controlled inlet line 175. An outlet from the submerged pump 105 connects to the vapor portion 320*a* of the low pressure LNG tank 320.

In operation, liquefied natural gas can flow in the system shown in FIG. 3 from the LNG tank 100 to the dispenser 110, through the submerged pump 105, or from the low pressure LNG tank 320. To be able to control the saturation pressure and temperature of LNG that reaches the dispenser 110, the liquefaction engine 125 works to remove heat from the natural gas within the low pressure LNG tank 320. Natural gas enters the low pressure LNG tank 320 either via the vapor relief line 397 or from the submerged pump 105 through the control valve 365.

As the liquefaction engine 125 operates, cold LNG accumulates in the low pressure LNG tank 320. If there is no demand for cold LNG from the use device, cold LNG can flow out through the relief line 395, to the dispenser 110, through the direct input line 140 (acting as a return line), into the LNG tank 100. Such return flow can take place when a predetermined amount of cold LNG has accumulated or when the pressure within the low pressure LNG tank 320 has reached a predetermined value.

When the temperature sensing valve controller 370 detects a need for cold LNG, it can activate the valve 365 between the submerged pump 105 and the low pressure LNG tank 320. This causes cold LNG to flow from the liquid portion 320*b* of the low pressure LNG tank 320 through low pressure outlet line 396 to the temperature controlled inlet line 175.

Figure 4:
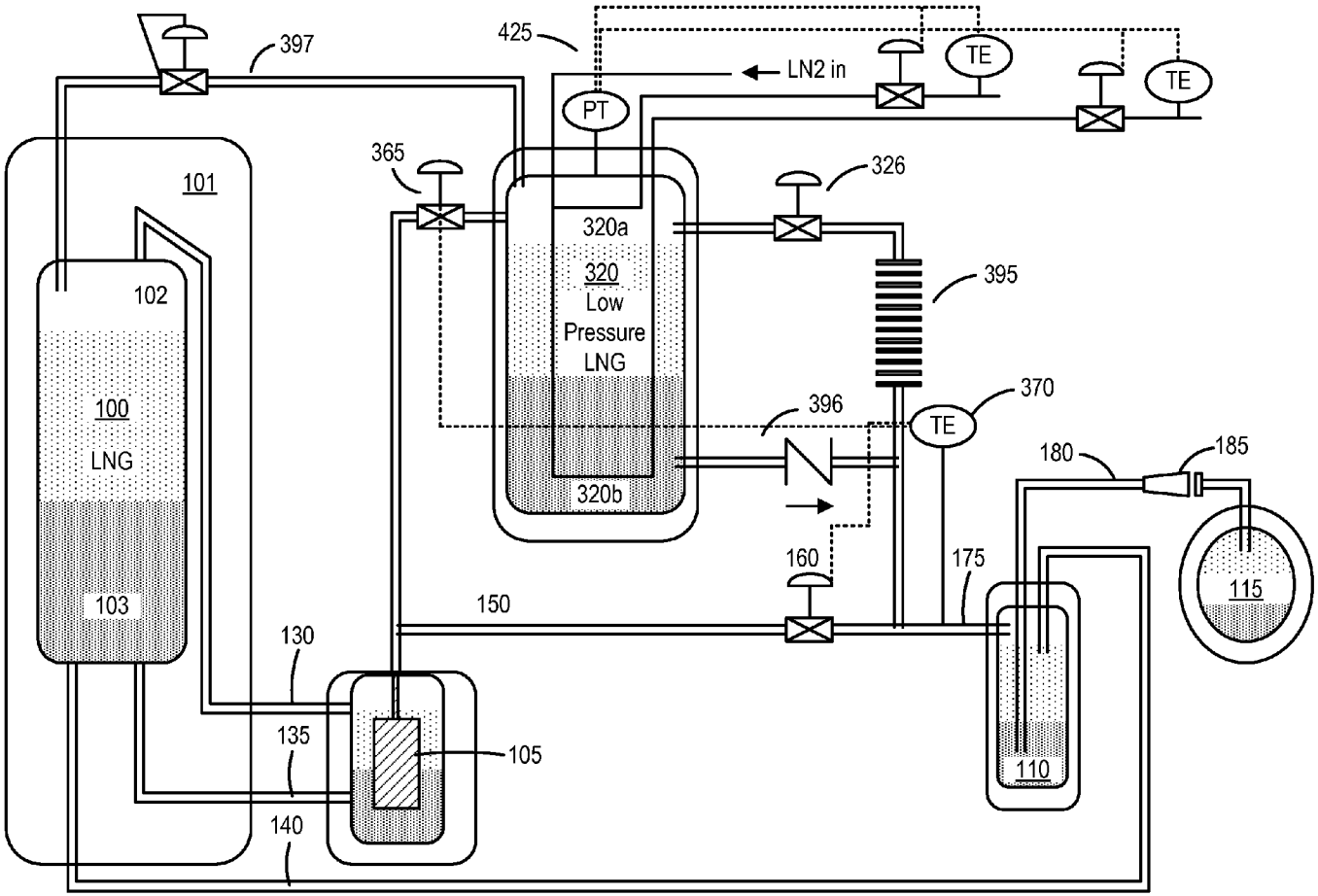
FIG. 4 shows an exemplary system diagram of a liquefied natural gas storage and delivery system as in FIG. 3 in which the liquefaction engine utilizes liquid nitrogen.

FIG. 4 shows an exemplary system diagram of a liquefied natural gas storage and delivery system as in FIG. 3 in which the liquefaction engine 425 utilizes liquid nitrogen instead of electricity to remove heat from the LNG flowing through the delivery system. The liquefaction engine 425 has lines through which liquid nitrogen flows within the low pressure LNG tank 320. The liquid nitrogen lines form a circuit that passes through the vapor portion 320*a* of the low pressure LNG tank 320, as well as the liquid portion 320*b*. A pressure sensor that indicates the pressure within the low pressure LNG tank 320 works in conjunction with valves and temperature sensors that indicate the temperature of liquid nitrogen leaving the low pressure LNG tank 320 to control the flow of liquid nitrogen, and thus the temperature and saturation pressure of LNG within the low pressure LNG tank 320.

Though the apparatus, systems, and methods herein are described with respect to fuel storage and delivery, particularly for liquefied natural gas (LNG) used as a fuel for vehicles, the apparatus, systems, and methods can be used with other cryogenic fluids. The apparatus, systems, and methods can also be used for any type of storage and delivery systems of cryogenic fluids. The descriptions of exemplary embodiments associated with the figures provided may not include controls and system regulation features such as service valves, thermal safety valves, level and gauging circuits, primary pressure relief circuits, and fill circuits.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Although embodiments of various methods and devices are described herein in detail with reference to certain versions, it should be appreciated that other versions, methods of use, embodiments, and combinations thereof are also possible. Therefore the spirit and scope of the appended claims should not be limited to the description of the embodiments contained herein.

What is claimed is:

1. A system for delivering a cryogenic fluid fuel at a predetermined saturation pressure to a fuel tank, the system comprising:

a source tank with a top portion and a second portion, the source tank containing a fuel, the fuel comprising a gas portion and a liquid portion;

a pump fluidly connected to the top portion of the source tank by a vapor line and the bottom portion of the source tank by a liquid line, the pump configured to pump the fuel from the source tank towards a vehicle fuel tank;

a cooling component comprising a second tank containing a cooling cryogenic fluid, the cooling component fluidly connected to a liquefaction engine, the pump, and a controlled inlet line, the controlled inlet line fluidly connected to the vehicle fuel tank;

a cooling line connecting the pump to the cooling component, the cooling line having a first end connected to the outlet of the pump and a second end connected to a vapor inlet of the second tank of the cooling component;

an ambient temperature line with a first end connected to the outlet of the pump and a second end connected to the controlled inlet line;

a low pressure output line that connects a liquid portion of the second tank to the controlled inlet line;

a dispenser tank fluidly connected to the controlled inlet line and to the vehicle fuel tank;

a direct input line with a first end fluidly connected to the source tank and a second end fluidly connected to the dispenser tank;

a vapor relief line having a first end connected to a vapor inlet of the second tank of the cooling component and a second end connected to the source tank, the vapor relief line configured to convey the vapor portion of the fuel from the source tank to the second tank of the cooling component; and a temperature sensing valve controller connected to:

a cold fuel control valve at the second end of the cooling line;

a warm fuel control valve at the second end of the ambient temperature line; and the controlled inlet line, the temperature sensing valve controller configured to measure a temperature of the fuel in the controlled inlet line and control the flow of fuel through the cold fuel control valve and warm fuel control valve to maintain the temperature of the fuel in the controlled inlet line within a predetermined temperature range, wherein the fuel comprises liquefied natural gas at a first pressure and the cooling cryogenic fluid comprises liquefied natural gas at a second pressure, the first pressure lower than the second pressure;

and wherein when the temperature sensing valve controller detects need for an increase of cold fuel to the use device, the temperature sensing control valve activates the cold fuel control valve to cause cold fuel to be pumped from the source tank into the second tank through the cooling line, thereby cooling the second tank and forcing cryogenic fluid in the second tank to flow out of the second tank through the low pressure output line to the controlled inlet line and toward the use device;

and wherein when a predetermined amount of cryogenic fluid accumulates in the second tank, cryogenic fluid flows out of the second tank of the cooling component, through the dispenser tank, and into the source tank via the direct input line.

2. The system of claim 1, wherein the liquefaction engine is configured to remove heat from the cooling cryogenic fluid using electrical energy.

3. The system of claim 1, wherein the liquefaction engine comprises heat removing lines through which a heat removing fluid flows, the heat removing lines connected to a separate source of heat removing fluid, the flow of heat removing fluid controlled by one or more liquefaction engine valves to maintain a pressure of the cooling cryogenic fluid in the cooling component.

4. The system of claim 1, wherein activation of the cold fuel control valve by the temperature sensing valve controller causes the cooling cryogenic fluid in the second tank to flow through low pressure outlet line to the controlled inlet line.

* * * * *